United States Patent [19]

Kurematsu et al.

[11] Patent Number: 4,933,698

[45] Date of Patent: Jun. 12, 1990

[54] AUTOMATIC DEVELOPING MACHINE FOR DISK FILM

[75] Inventors: Masayuki Kurematsu; Shigeharu Koboshi, both of Hino, Japan

[73] Assignee: Konica Corporation, Tokyo, Japan

[21] Appl. No.: 302,793

[22] Filed: Jan. 26, 1989

[30] Foreign Application Priority Data

Jan. 30, 1988 [JP] Japan ..... 63-20462
Jan. 30, 1988 [JP] Japan ..... 63-20465

[51] Int. Cl.[5] ..... G03D 3/08
[52] U.S. Cl. ..... 354/298; 354/319
[58] Field of Search ..... 354/298, 310, 311, 312, 354/329, 330, 319; 414/786, 412

[56] References Cited

U.S. PATENT DOCUMENTS 4,208,116 6/1980 Morse ..... 354/275
4,248,564 2/1981 Gentile et al. ..... 414/786
4,429,980 2/1984 Miller ..... 354/330

*Primary Examiner*—A. A. Matthews
*Attorney, Agent, or Firm*—Jordan B. Bierman

[57] ABSTRACT

An automatic developing machine for a disk film comprises, a passage of a cartridge or the disk film, a sensor to detect whether the cartridge or the disk film exists in a portion of the passage or not, and means for controlling operation of the machine according to a signal sent from the sensor. The automatic developing machine mentioned above further comprises a cartridge opener, and the sensor detects whether the disk film has been taken out from the cartridge by the cartridge opener or not.

20 Claims, 7 Drawing Sheets

AUTOMATIC DEVELOPING MACHINE FOR DISK FILM

FIELD OF THE INVENTION

This invention relates to a automatic developing machine for disk film.

More specifically, this invention relates to an automatic developing machine which is suitable for developing a small number of disk films, that is, fewer than ten films, and continuously sets the disk films to be processed in a unit while storing a disk film in a cartridge.

BACKGROUND OF THE INVENTION

Conventionally, a disk film is taken out of a cartridge and reset in a separate automatic developing machine to be processed utilizing a cartridge opener described in for example, U.S. Pat. Nos. 4,208,116 and 4,248,564, and "All about Kodak Disk Film" (pp. 26–41, Shashin Kogyo, April, 1982).

As a type with which a cartridge opener is installed in an automatic developing machine and disk films are continuously taken out of a cartridge and processed, various applications have been made related to the application made by these applicants such as Patent Application Nos. 297847/1985, 21860/1986, 70083/1986, 213892/1987, Utility Model Nos. 138087/1987, and 138088/1987.

The inventors attribute the reason of low popularity for disk films, in spite of their numerous advantages, to slowness in processing service due to the low installation rate of automatic developing machines for disk films. Based on such a recognition, they have devoted themselves to research on a compact automatic developing machine for disk films which satisfies requirements such as small processing amount, prompt processing, and compactness of the machine. This invention is one of the achievements of such research.

If proliferation of compact automatic developing machine is tried by installing such machines in the relatively small storefront of DPE service shop or camera shop, it is expected that a remarkable difference in the number of films processed will occur depending on the place of installation and hour of the day. Therefore, even if the number of disk films which can be processed is only one, it is possible to shorten the processing time as a whole by making the succeeding disk film stand by in the middle of the processing step, for example, at the step after taking such a film from a cartridge.

With a type of unit in which a disk film is stored one by one and processed one at a time or in turn, if the processing time per film is within 5 minutes, a considerable number of films can be processed even if the unit is a compact one.

In order to realize the above, it is necessary to effectively and automatically control setting of the cartridge in the unit, operation start of the cartridge opener, completion of removal of a disk film, countermeasures for malfunction, etc.

This invention has been made in consideration of the above conditions. Its main objective is to provide and improve an automatic developing machine which continuously supplies disk films while storing them in a cartridge, especially its operation control mechanism.

Moreover, in the case of photosensitive materials, whether it is a disk film or not, it is necessary to transfer the material to another light-tight structure or place it in a black box after removing it from a cartridge or magazine.

However, in a system where a compact automatic developing machine is installed in a storefront, the developing machine is not placed in a dark room. In this case, the disk film whose cartridge has been broken can not be removed from the machine in an undeveloped condition.

Therefore, if a cartridge opener operates incorrectly and a disk film is not taken out from a cartridge, it is necessary to provide a means which safely takes out the disk film together with a cartridge from the machine.

In addition, the inventors have found out that the disk film presently on market has slightly different adhesive strength of the two plates which constitute a cartridge depending on the manufacturer, which sometimes resulted in malfunction of a cartridge opener. Therefore, it is necessary to provide a safety measure for such a condition.

In consideration of the foregoing another objective of this invention is to provide a cartridge opener which is equipped with a mechanism to safely take out a disk film contained in a partly broken cartridge outside the machine if a cartridge opener functions incorrectly or breaking of a cartridge is not properly done depending on the manufacturer of disk film and an automatic developing machine equipped with such a cartridge opener. The objective and profits of this invention are clarified in the following descriptions and the attached drawings.

SUMMARY OF THE INVENTION

The summary of the present invention is described as follows.

An automatic developing machine for a disk film comprising, (a) a passage of a cartridge or said disk film;

(b) a sensor to detect whether said cartridge or said disk film exists in a portion of said passage or not; and (c) means for controlling operation of said machine according to a signal sent from said sensor.

The automatic developing machine mentioned above further comprising a cartridge opener, and said sensor detects whether said disk film has been taken out from said cartridge by said cartridge opener or not.

The automatic developing machine mentioned above comprising, a light-tight structure to stock said cartridge from which said disk film has not been taken out by said cartridge opener.

The present invention to achieve the above mentioned objectives features controlling of the movement of a succeeding cartridge or disk film or the operation of the incorporated unit according to the information of existence or non-existence of a preceding cartridge or disk film which is detected by a sensor while dividing the passage from the inlet of a cartridge to the exit of a processed disk film into plural number of sections.

The cartridge opener used in this invention features a means to detect a condition in which a disk film is not taken out in spite of breakage of a cartridge and a means to store a malfunctioning disk film and cartridge in a light-tight structure according to such information detected.

The automatic developing machine for a disk film having a cartridge opener to achieve the above-mentioned objectives features a means to detect a condition in which a disk film is not removed in spite of breakage of a cartridge and a means to store a malfunctioning disk film and cartridge in a light-tight structure according to such information detected.

A preferable embodiment of the present invention is explained as follows.

(1) A light-tight structure is installed below the cartridge opener and a cartridge from which a disk film has not been taken out because of malfunction drops into the structure by gravity of itself.

(2) A stocker into which as empty cartridge drops by gravity is light-tight. In this case, an empty cartridge means a cartridge from which a disk film has been taken out by a cartridge opener.

(3) A light-tight structure into which a cartridge with a disk film in it because of malfunction drops by gravity, is provided besides a stocker for an empty cartridge.

(4) A guide means is provided that can guides a cartridge from which a disk film has not been taken out because of malfunction into a light-tight structure by changing the passage.

DESCRIPTION OF THE PREFERRED EMBODIMENT

An embodiment of the present invention is explained below using the attached drawings.

Figure 1:
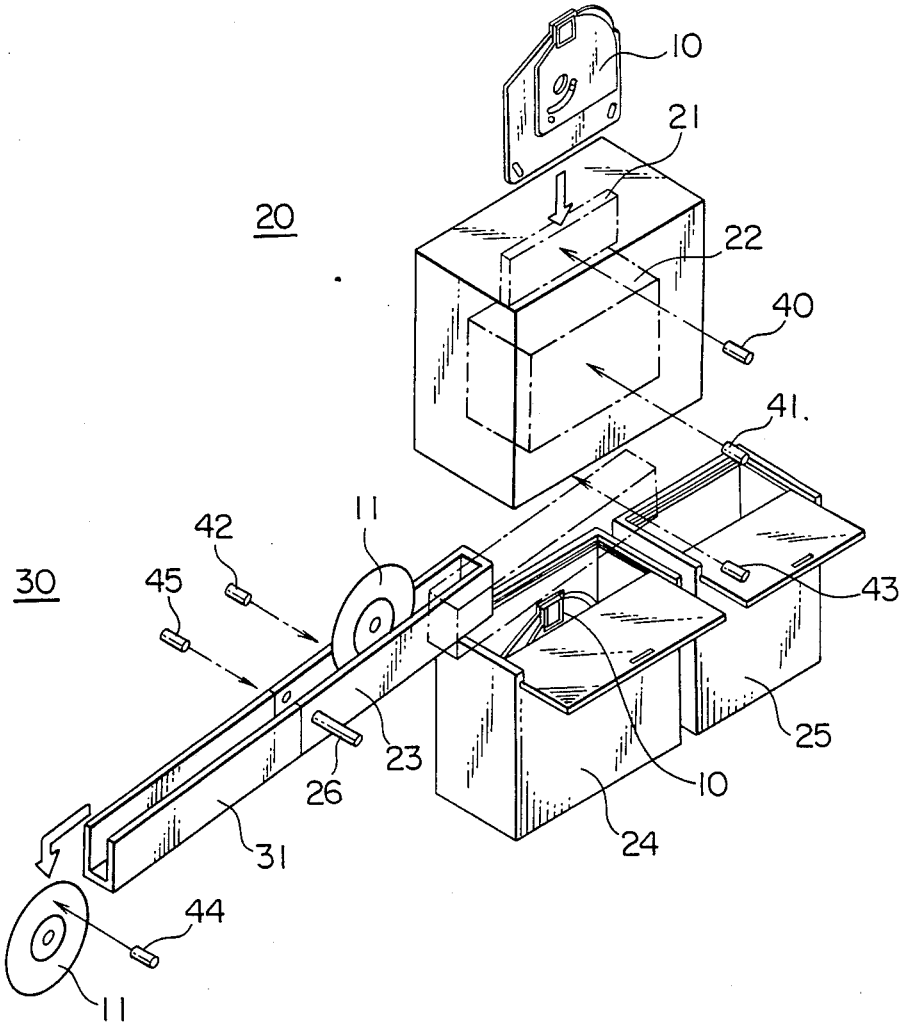
FIG. 1 is a schematic drawing which shows one example of the automatic developing machine to which the present invention is applied.

FIG. 1 is a schematic drawing of the invention. In the drawing, the numeral 10 represents a cartridge which stores a disk film to be processed. The numeral 11 is a disk film which is taken out of the cartridge 10.

The numeral 20 is a preprocessing system which removes the disk film from the cartridge 10 and sends it to a processing system 30. The numeral 21 represents a cartridge inlet; 22, a cartridge opener; 23, a guide path; 24, a stocker which stores the emptied cartridge 10; 25, a black box which stores the disk film 11 in case the disk film 11 is not removed even if the cartridge is broken because of malfunction of the cartridge opener 22.

The numeral 30 represents a processing system. This processing system includes a retaining/transferring means of the disk film 11, a processing tank, a means to supply processing solution, a means to control the temperature of the solution, a drying means, and the like. Each specific system allows a wide variety of configurations.

The numerals 40 through 45 represent sensors. As a sensor, an infrared sensor which comprises a pair consisting of infrared emitter and receptor is most preferably adopted, but it is not limited to this configuration. In the following explanation when the word "sensor" is used, it means a single sensor as well as a combination of sensors.

The sensor 40, located near the cartridge inlet, detects the existence (insertion) of the cartridge 10.

This sensor 40 includes a function to check whether or not the position of the inserted cartridge 10 is normal.

This sensor 40 also includes a signal generating means which realizes the manipulation of information to reject the insertion (receiving) of the cartridge to be processed next or a certain member, for example, a stopping device, when the existence of the cartridge 10 or disk film 11 which is unprocessed or beginning to be processed in the preprocessing system 20 is confirmed. When the cartridge 10 or disk film 11 exists in the preprocessing system 20, the cartridge inlet 21 is closed by a stopping device. If absence is confirmed (including confirmation of discharge of the disk film and the emptied cartridge), the stopping device may be controlled to be released to allow the insertion (receiving) of the cartridge 10.

The sensor 41 detects the start of the operation of the cartridge opener 22 by movement, rotation, oscillation, etc. of the operating member.

When the control is made by, for example, a microcomputer, it is possible to synchronize the operation of the cartridge opener 22 and a counter instead of providing the sensor 41.

The sensor 42 detects passing of the disk film 11. Therefore, if the sensor 42 does not detect the disk film 11 within a certain period of time after the sensor 41 detects the actuation of the cartridge opener 22, it means that the disk film 11 was not removed normally. Then the operation of the cartridge opener 22 is repeated or the operation is temporarily stopped because of jamming. It is preferable to limit the repetition of the operation of the cartridge opener to twice or several times.

If the disk film is not taken out even though the cartridge 10 is broken, a jam is indicated by a buzzer or light and the operation of the cartridge opener 22 is stopped. The jammed cartridge 10 is automatically or manually transferred to the black box 25, while containing the disk film 11, and then treated separately.

When the sensor 42 confirms that the disk film 11 has passed, the emptied cartridge is disengaged from the cartridge opener 22 and discharged into the stocker 24. The sensor 43 detects the discharge of the emptied cartridge 10. If the discharge is not detected within a certain period of time, it is regarded that a jam has occurred.

A stopper 26 is provided in the middle of the guide path 23. When the processing system 30 is full with disk films to be treated, this stopping device 26 actuates to put the disk film in a standby mode. In this status, the next cartridge 10 ca be inserted and engaged to the cartridge opener 22. Here, the cartridge opener is maintained in a standby mode.

When the sensor 44 detects that the preceding disk film 11 has been processed (the processing system 30 is emptied), the stopping device 26 is released and opens the guide path 23. Then the disk film which is in a standby mode is transferred to the guide path 31 of the processing system 30. The sensor 45 detects that the new disk film 11 is transferred to the guide path 31 and the film is fed into the processing system 30. The disk film is retained and transported by an optional mechanism in the processing system 30. For example, it is preferable to retain the core section of the disk film 11 by using a chuck provided at the front end of a spindle.

When a series of processes in the processing system 30, from color developing to drying, has been completed, the disk film 11 is returned to the guide path, detected by the sensor 44, and discharged out of the unit. If the time required from the detection of the disk film 11 by the sensor 45 to the detection by the sensor 44 exceeds a certain period of time, it is regarded that a jam has occurred in the processing system 30.

When the processed disk film 11 is not detected by the sensor after having been returned to the guide path 31, it is regarded that a jam has occurred on the guide path 31.

If the disk film 11 does not come out of the cartridge 10 even if the cartridge opener 22 is activated, or if the emptied cartridge does not disengage from the cartridge opener 22, it is preferable to prevent a jam by oscillating the cartridge opener 22 or blowing the air into the opener.

It is also preferable to prevent the disk film 11 from being caught on the guide paths 23 and 31 by oscillating the guide path member, blowing air in the advancing direction, or moving a sweeper member which is not shown in the drawing.

According to this invention, the path from the cartridge inlet to the discharge outlet of a processed disk film is divided into several sections so that a cartridge or disk film is moved forward or the operation of the apparatus is stopped (made standby). In this way, a cartridge (disk film) to be processed can be continuously at regular intervals fed without causing a jam. As compared to a conventional developing machine in which a new cartridge is set in position after the processing of the preceding disk film is completed, a considerable amount of time can be saved as a whole even if the developing machine according to this invention is a small sized one. Thus, the objective mentioned in the beginning can be achieved.

This invention is particularly effective when the number of disk films fed into the processing system is limited to four and each film is successively transferred to the processes of color developing through drying (in this case, the processing time of each step should preferably be the same), as compared to the developing machine in which a plural number of disk films fed into the processing system are simultaneously processed at each step.

The second embodiment of the present invention is explained as follows using the attached drawings.

Figure 2:
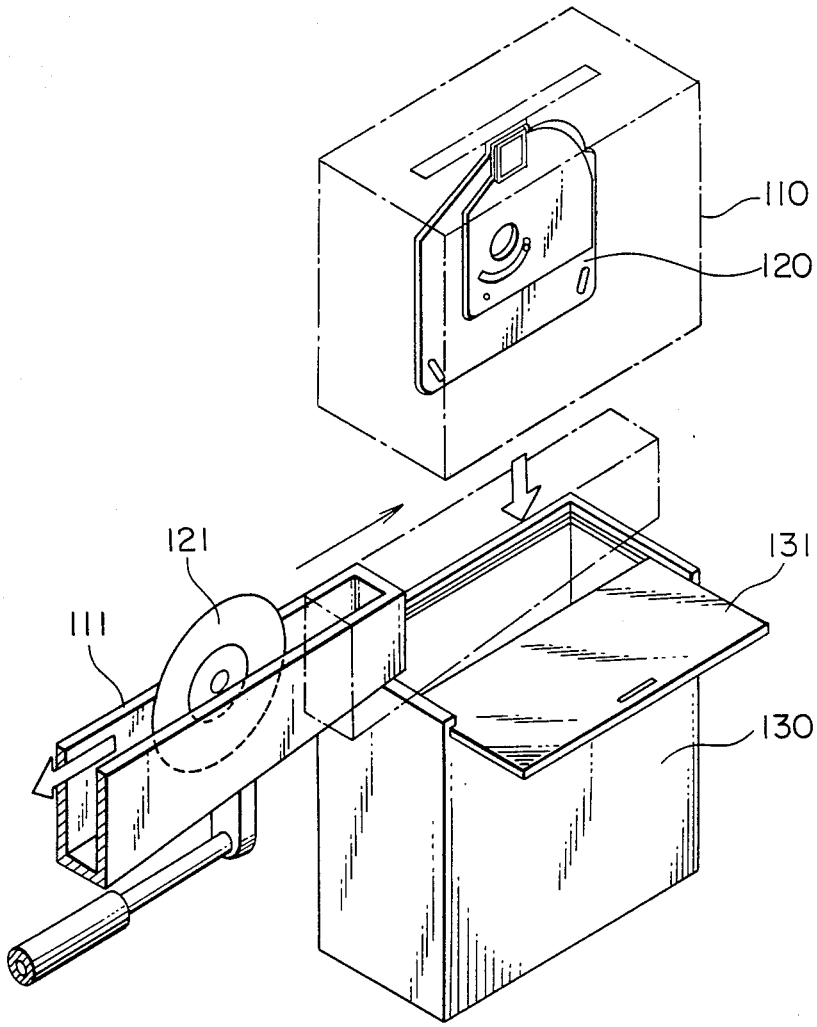
FIG. 2 is a schematic drawing which shows an example of a means to store a cartridge opener and cartridge in a light-tight structure according to the present invention.

In FIG. 2, the numeral 110 represents a cartridge opener body. Various configurations consisting of a means to set, retain, and break the cartridge can be adopted, other than the cartridge opener type according to the invention made by the present applicant. The following configuration is one of them. The numeral 111 represents a guide path which guides a disk film 121 to a processing section after it is taken out from a cartridge 120 in a normal condition. This guide path 111 shifts in the direction of the arrow mark, stands under the cartridge body 110, and waits for the disk film 121 to be taken out from the cartridge 120 and dropped. When a sensor provided in the guide path 111 or processing section detects that the disk film 121 is dropped and guided to the processing section, the guide path 111 moves in the direction opposite to the arrow mark and the lower part of the cartridge opener body 110 is released. The guide path 111 is moved by a motor or other means which is not shown in the drawing.

When the emptied cartridge 120 is released in this status, the cartridge 120 drops and is stored in a stocker 130 which is ready to accept the cartridge.

Accordingly, in the first configuration of this invention, the stocker is provided with, for example, a cover 131, which makes a light-tight structure. In other words, when the cartridge opener actuates normally, the stocker 130 can be a structure with an open top because it is used merely to store the emptied cartridge 120. However, with the stocker 130, which is designed to fulfill the objective of this invention, the upper part is released in the standby mode as an inlet of the cartridge. If the disk film 121 is not taken out in a normal condition, the disk film 121 is dropped into the stocker 130, while being contained in the broken cartridge 120. If the cover 131 of the stocker 130 is closed, the stocker 130 becomes a light-tight structure. Then it is possible to take out the stocker from the machine and the disk film 121 can be removed from the cartridge in a dark room.

If a spare stocker 130 is prepared to cope with the above condition, it is not necessary to interrupt the operation of the automatic developing machine.

In the case that the disk film 121 is taken out of the cartridge outside the machine, it is necessary to provide a means which re-stores the removed disk film 121 in a light-tight applicator similar to the cartridge 120 and supplies the disk film 121 to the developing machine after setting the applicator in the cartridge opener 110 as in the case of the ordinary cartridge 120 or a means which inserts such an applicator into the guide line 111 and supplies the disk film 121 to the processing section.

In the second configuration of the invention, a light-tight structure which is a substitute for the stocker 130 is provided. If malfunction of the cartridge opener occurs, the stocker 130 is taken out, the light-tight structure is reset, and the disk film 121 is dropped into this light-tight structure while being contained in the cartridge 120 to interrupt the light. Then the structure is taken out of the machine and the film is processed separately in the manner mentioned above.

In the above configuration, the lower part of the cartridge opener 110 should be closed when the stocker 130 is taken out. For example, a light-tight plate is shifted to realize closing. Such a light-tight plate is preferably designed to operate automatically being connected with the removal of the stocker 130 or its substitute, a light-tight structure.

Figure 3A:
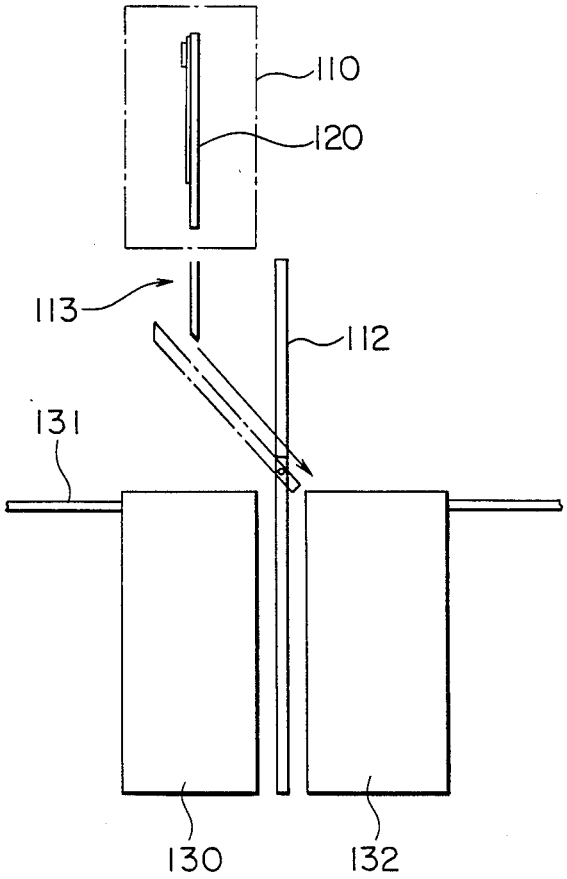
FIG. 3(A) is a schematic drawing which shows other examples of the above means.

The third configuration of the invention is shown in FIG. 3(A). In this configuration, a container 132 of light-tight structure is provided, other than the stocker 130, to store the cartridge 120. When a malfunction occurs, a path changing plate 112, for example, is shifted to the direction shown with the broken line to change the path. The disk film 121 is stored in the container of light-tight structure while being contained in the broken cartridge 120 and then processed separately.

The numeral 113 represents the leading part of a cartridge which is delivered from the cartridge opener 110 after being processed in it.

As a means to detect the occurrence of a malfunction, the time required from the start of operation of the of the opener to the detection of the disk film by a sensor is measured. Another way is to check the data of passing of a disk film when the data of start of operation of the opener is obtained.

According to this invention, even if a disk film is not taken out in case the cartridge is broken due to malfunction of the cartridge opener, such a disk film can be easily taken out of the machine and separately processed. Thus, the objective mentioned in the beginning can be achieved.

Figure 3B:
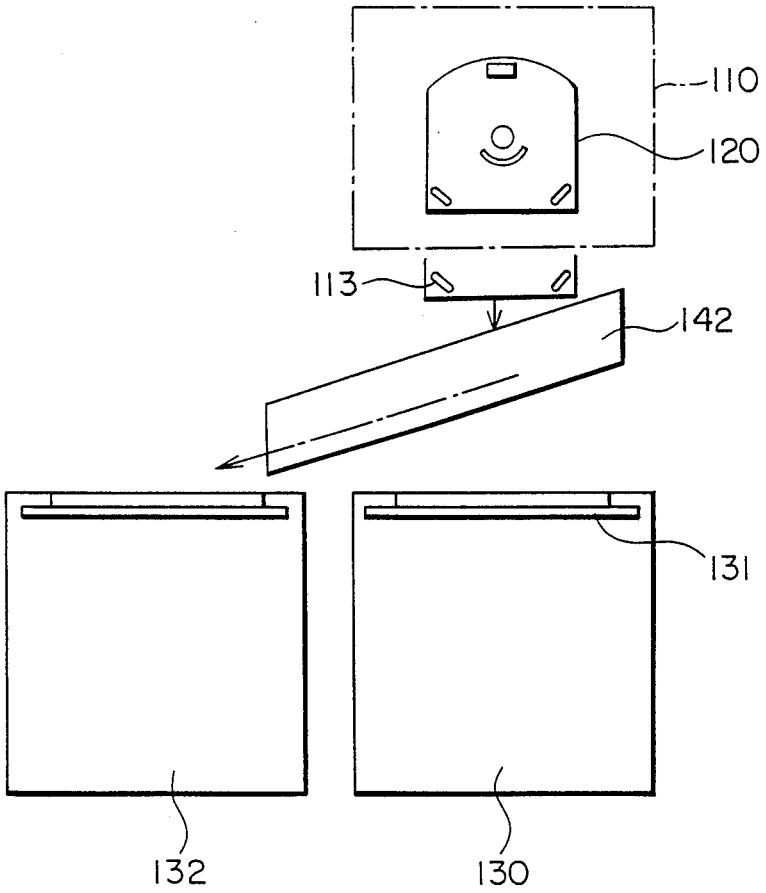
FIG. 3(B) is a schematic drawing which shows other examples of the above means.

The third configuration of the invention in FIG. 3(A) shows one of the examples of arrangement of a stocker 130 and a light-tight structure 132. The arrangement is described as follows. The stocker 130 is installed right under the cartridge opener 110 and the light-tight structure 132 is installed beside the stocker 130 in the right side of the stocker in FIG. 3(A). But the light-tight structure 132 can be installed beside the stocker 130 in this side in FIG. 3(A). FIG. 3(B) shows this arrangement of the light-tight structure 132. In this case, the guide 142 has a section of U-shape to guide a cartridge from which a disk film has not taken out because of malfunction of the cartridge opener 110 to the light-tight structure 132 properly.

The guide 142 can be shifted by a motor mechanism which is not shown in the drawing to assort a cartridge according a signal sent from a sensor. In other words, when a cartridge from which a disk film has been taken out drops into a stocker 130, the U-shaped guide 142 is shifted from the passage of the cartridge. When a cartridge from which a disk film has not been taken out because of malfunction drops from the cartridge opener 110, the guide 142 is shifted to the passage in order to accept and carry the cartridge to the light-tight structure 132.

As a third embodiment, an invention of a method to easily and precisely set a disk film into a cartridge opener related to this invention will be explained.

Figure 4:
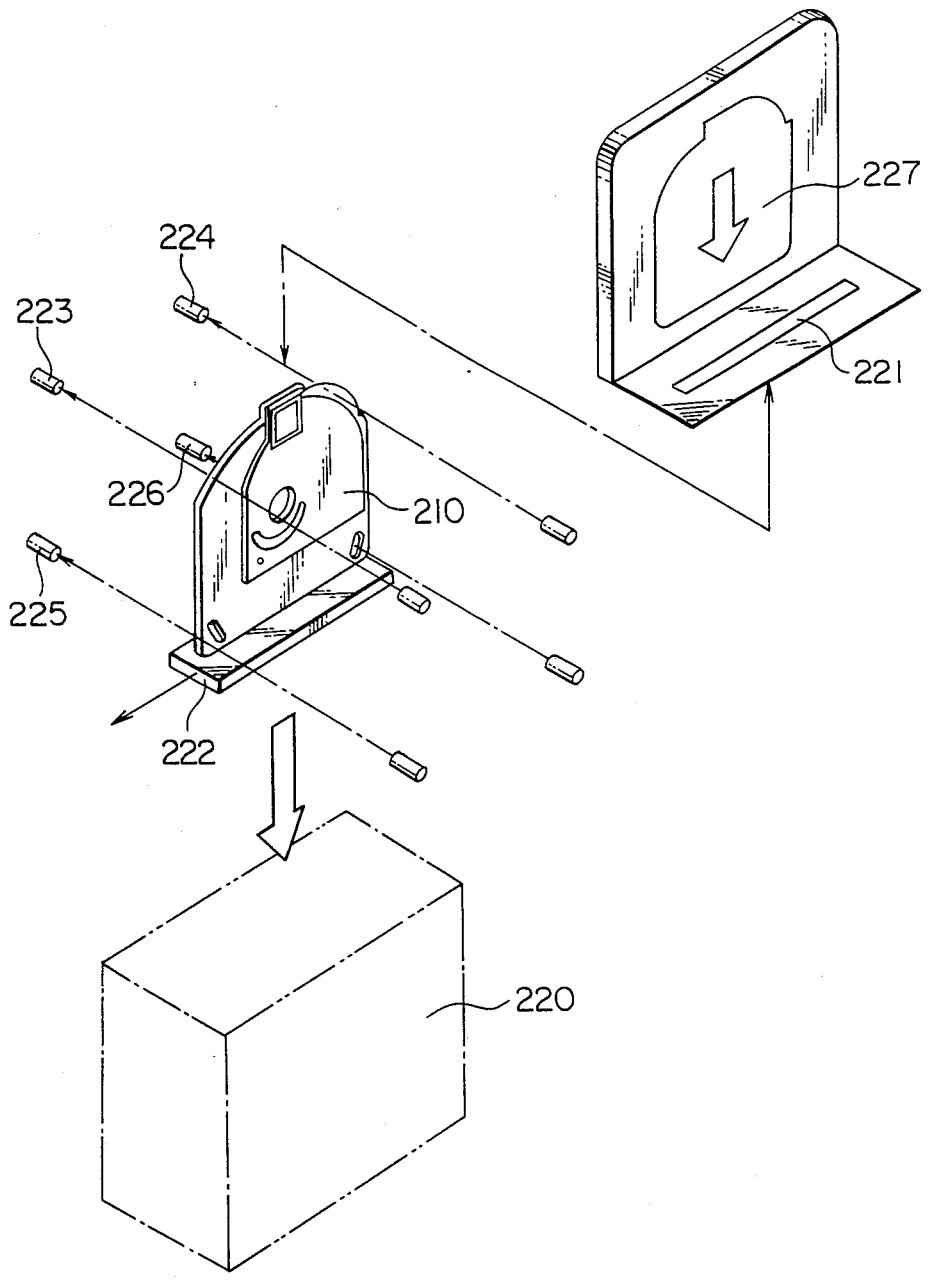
FIG. 4 is a schematic drawing of a cartridge opener.

In FIG. 4, the numeral 210 represents a cartridge for a disk film which is obtained on the market. The numeral 220 represents a cartridge opener body. The cartridge 210 is vertically inserted from an inlet 221 prepared above the cartridge opener 220 and temporarily stopped at the position where the drop movement is regulated by a stopping device 222.

As shown in the figure, the stopping device 222 is located at a position to stop the cartridge 210 in a normal position. When it allows the cartridge 210 to pass, the stopping device moves in the direction shown by the arrow mark to let the cartridge drop freely into an opener body 220 which is prepared below.

In the embodiment shown in the figure, the cartridge 210 is temporarily stopped, checked for its position mentioned later, and then supplied to the opener body 220. It is also possible to be designed so that the opener body 220 actuates in the position where the cartridge is stopped by the stopping device 222.

The numerals 223 through 226 represent sensors consisting of a pair of emitting element and receiving element. Preferably, but not necessarily, an infrared sensor is used.

In this first configuration of the invention, whether the cartridge 210 is properly inserted is checked by a single sensor 223. The light path from the corresponding emitting element which activates the sensor 223 is located on the notched section of the cartridge 210 as shown in the figure. Therefore, the passages of infrared rays are not interrupted as in the case of other corners of the cartridge 210.

In this configuration, it is necessary to provide a means which detects insertion of the cartridge 210. One way is to detect the load applied to the stopping device 222. A manual start switch may also serve this purpose. The most preferable method, however, is to detect the existence of the cartridge 210 by one or all of the sensors 224 through 226.

With such a configuration, proper insertion of the cartridge 210 can be confirmed if the sensor 223 is inputted after the existence of the cartridge 210 is detected. Then the next step can be started. If the sensor 223 is not on, in other words, if the infrared ray from the corresponding emitting element is interrupted by a part of the cartridge 210 as shown in the figure with the sensor 224, there is no input from the sensor 223. Such is the case when the cartridge 210 is upside down or wrong-sided as compared with the figure. In this case, missetting is indicated or more preferably, a retracting operation through the inlet 221 of the cartridge 210 or discharging operation through a guide path not shown in the figure is performed. As a mechanism to retract the cartridge via the inlet 221, a mechanism to shift the stopping device 222 upward and raise the cartridge 210 which has been inserted by mistake can be used.

In the second configuration of the invention, the sensor 223 and one of the sensors 224 through 226 make a pair. For example, the sensors 223 and 224 make a pair. If one of the sensors detects "no input" condition, it means that "the cartridge 210 exists." When the sensor detects "input" in this condition, "cartridge properly set" is judged. If the cartridge 210 is set upside down or wrong-sided, the sensors 223 and 224 both detect "no input", and "cartridge not properly set" is judged.

The second sensor can be located in any position where the infrared ray is interrupted by the cartridge 210 other than the positions shown in the figure by sensors 224 through 226.

Another configuration of this invention includes more than three sensors. For example, four sensors can be provided as shown in the figure by the sensors 223 through 226. In this case, the position of the sensor which detects "no input" judges whether the cartridge 210 is properly set or not.

In the drawing, the numeral 227 represents an indication to prevent setting error which is provided near the inlet 221 of the cartridge 210. This indication shows how to set the cartridge correctly using a picture or illustration.

If the cartridge 210 is incorrectly set, the above mentioned setting position check mechanism judges setting error and resetting is required. If setting error is repeated, time is wasted and processing is delayed. Therefore, it is useful to provide such a visual indication shown by the numeral 227.

Data detected by a sensor is preferably processed by a built-in microcomputer and automatically controlled together with the operations of other mechanisms. It is also possible to control this part alone. Moreover, control by relay without computer can also be adopted.

As a cartridge opener represented by the numerals 220, various types which have not been presented here can be used other than the small sized cartridge, according to the present invention, mentioned in the section of BACKGROUND OF THE INVENTION.

With this invention, setting error of a cartridge is immediately detected and the operation of the entire machine or one part (especially, a cartridge opener body) is stopped. The cartridge which was incorrectly set is returned or discharged. Thus, an accident of breaking a cartridge by mistake is effectively prevented.

By providing such a safety measure, even an inexperienced operator can use the machine.

As a fourth embodiment, an example of the invention to easily and precisely remove the disk film from the cartridge will be explained using the attached drawing.

Figure 5:
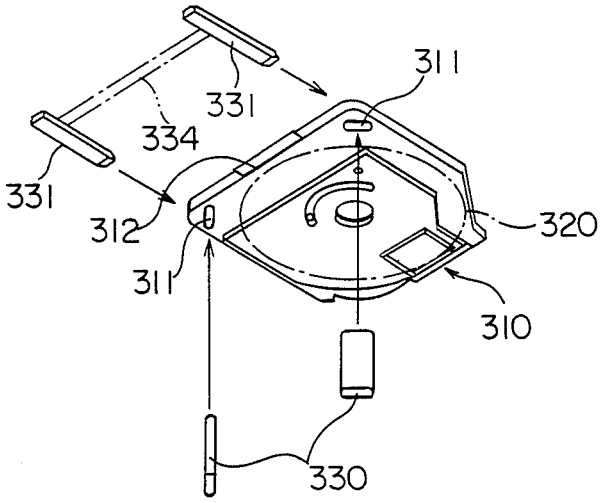
FIG. 5 through 9 are schematic drawings which show the structure of a cartridge.

FIG. 5 is a schematic drawing of an embodiment of the invention. In the drawing, the numeral 310 represents a cartridge in which a disk film 320 which is to be processed is stored. The numeral 330 represents a pair of pushing rods to break the end of the cartridge 310. These rods are inserted into openings 311 and 311 prepared on the cartridge 310 to push up the opposite plate and break the part which is adhering.

When breaking the end portion of the cartridge 310, it is preferable to break the center of the end portion 312 in the same manner, as well as the corner portions where the openings 311 and 311 exist.

When breaking the end portions with the pushing rod 330, etc., it is necessary to hold from the top the upper edge of the plate where the openings 311 and 311 are provided.

Figure 6:
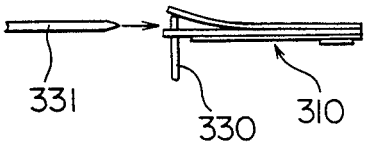

When the pushing rods 330 and 330 are operated, the end of the cartridge 310 is slightly opened as shown in FIG. 6. Then a material such as a wedge member 331 can be inserted and moved in the direction of the arrow mark.

As the same applies to the configuration explained below, moving the wedge member 331 in the direction of an arrow mark is equivalent to moving the cartridge 310 in the direction opposite to the arrow mark while making the wedge member 331 a fixed type. Moving the wedge member and the cartridge toward each other is also the same.

Figure 7:
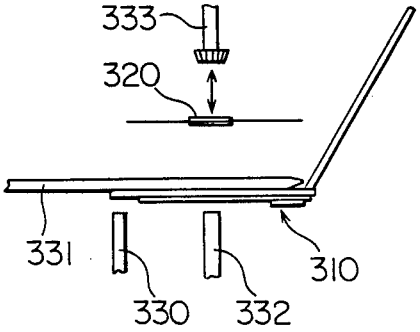

When a moving stroke of the wedge member 331 reaches the limit, the two plates which make up the cartridge 310 become wide open as shown in FIG. 7. The disk film which has been stored released from the cartridge 310 and it is ready to remove the film by an appropriate means.

The wedge members 331 and 331 may be or are connected to a bar or plate 334 shown by the broken line in FIG. 5. In such a configuration, the wedge members 331 and 331 enter into both edges of the two plates which make up the cartridge 310. Thus, it is possible to open the cartridge 310 by the bar or plate 334 without breaking the hinged portion of the base end. Also there is no danger of damaging the stored disk film 320. If the wedge members 331 and 331 are wide plates, not only the hinged portion of the base end of the cartridge but also the disk film 320 may be damaged.

Figure 8:
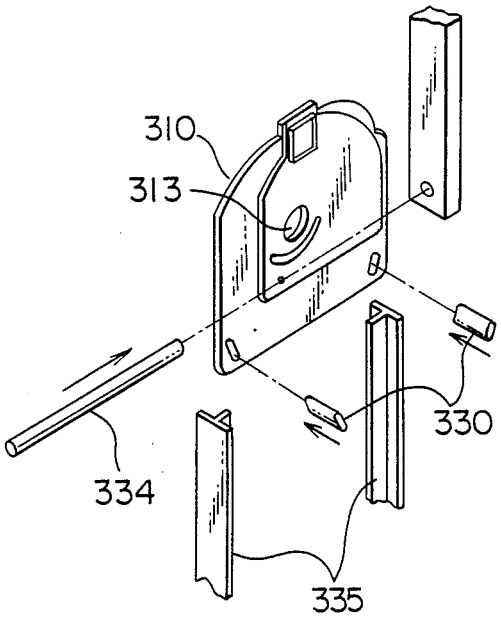
Figure 9:
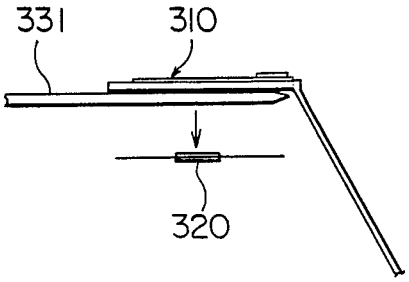

As a means of removing the disk film 320, mechanisms of various configurations can be used. One example is to insert a pushing rod 332 from a center opening 313 of the cartridge 331 and chuck the film with a tip of a spindle 333 prepared on the upper part by raising the pushing rod. Another example is to lower the spindle 333 to chuck the core section of the disk film 320 with its tip and lift the film. Still another example is to break the cartridge 310 while maintaining it in a vertical position as shown in FIG. 8 and let the stored film 320 drop of itself. Moreover, it is possible to open one of the plates of the cartridge 310 and let the stored film 320 drop of itself as shown in FIG. 9.

FIG. 8 shows various other embodiments of the present invention. In one example, the bar 334 is inserted into an internal space of the cartridge 310 generated by the action of the pushing rod 330 from the direction shown by an arrow mark, instead of using the wedge member shown in FIG. 5. While the tip of the bar is preferably fixed on the opposite side, the bar 334 is moved upward or, while the bar 334 is fixed, the cartridge 310 is pressed down. In this way, the cartridge 310 is opened in a fan shape and the disk film 320 is caused to drop of itself.

This configuration is applicable to the case where the cartridge 310 is maintained horizontally as shown in FIGS. 5 through 7.

In the configuration shown in FIG. 8, a pair of guide members 335 are used instead of the wedge member shown in FIG. 5. In this case, after breaking the lower part of the cartridge 310 with the pushing rod, the end of the guide member 335 is engaged in the space generated. When the cartridge 310 is pressed, the cartridge 310 opens in a fan shape and the stored disk film 320 is released from the cartridge 310 and caused to drop of itself.

Among the above mentioned configurations, with a configuration in which the disk film 320 is dropped while retaining the cartridge 310 in a horizontal position, it is preferable to apply a slight rocking motion to the opened cartridge 310 anticipating the case in which the core of the disk film 320 is caught at the center opening 313 of the cartridge 310.

This invention realizes easy operation of each operating member utilizing a small size motor, solenoid, compressed air, etc. As a result, a compact developing machine which enables safe and secure removal of disk films without damaging such films can be obtained and the above-mentioned objective can be achieved.

What is claimed is:

1. An automatic developing machine for a disk film comprising, (a) a passage for a cartridge or said disk film;

(b) a sensor to detect whether said cartridge or said disk film exists in a portion of said passage;

(c) means for controlling operation of said machine according to a signal sent from said sensor, and (d) a cartridge opener, said sensor detecting whether said disk film has been taken out from said cartridge by said cartridge opener.

2. The automatic developing machine of claim 1 comprising, a first light-tight structure to stock said cartridge from which said disk film has not been taken out by said cartridge opener.

3. The automatic developing machine of claim 2 comprising, means for sending said cartridge from which said disk film has not been taken out by said cartridge opener into said first light-tight structure according to a signal from said sensor.

4. The automatic developing machine of claim 3, wherein said means for sending is a connection for said cartridge dropping by gravity between said cartridge opener and said first light-tight structure.

5. The automatic developing machine of claim 2 comprising, a second structure to stock a cartridge from which said disk film has been taken out by said cartridge opener.

6. The automatic developing machine of claim 5, wherein said second structure to stock said cartridge from which said disk film has been taken out by said cartridge opener, is light-tight.

7. The automatic developing machine of claim 3 comprising, a second structure to stock said cartridge from which said disk film has been taken out by said cartridge opener.

8. The automatic developing machine of claim 7, wherein said second structure to stock said cartridge from which said disk film has been taken out by said cartridge opener, is light-tight.

9. The automatic developing machine of claim 4 comprising, a second structure to stock a cartridge from which said disk film has been taken out by said cartridge opener.

10. The automatic developing machine of claim 9, wherein said second structure to stock said cartridge from which said disk film has been taken out by said cartridge opener, is light-tight.

11. The automatic developing machine of claim 4 comprising, means for guiding said cartridge from which said disk film has not been taken out by said cartridge opener to said first light-tight structure.

12. The automatic developing machine of claim 5, comprising means for guiding said cartridge from which said disk film has not been taken out by said cartridge opener to said first light-tight structure.

13. The automatic developing machine of claim 6, comprising means for guiding said cartridge from which said disk film has not been taken out by said cartridge opener to said first light-tight structure.

14. The automatic developing machine of claim 7, comprising means for guiding said cartridge from which said disk film has not been taken out by said cartridge opener to said first light-tight structure.

15. The automatic developing machine of claim 8, comprising means for guiding said cartridge from which said disk film has not been taken out by said cartridge opener to said first light-tight structure.

16. The automatic developing machine of claim 9, comprising means for guiding said cartridge from which said disk film has not been taken out by said cartridge opener to said first light-tight structure.

17. The automatic developing machine of claim 10, comprising means for guiding said cartridge from which said disk film has not been taken out by said cartridge opener to said first light-tight structure.

18. An automatic developing apparatus for developing a disk film contained in a cartridge comprising, (a) a cartridge opening mechanism;

(b) a processing mechanism for carrying out development of said disk film (c) a passage along which said disk film is transported whilst being subjected to various treatments including cartridge removal and development process;

(d) a sensor whereby the existence or non-existence of a cartridge or a disk film is detected; and (e) a means for controlling the treatment or the movement of a cartridge or a disk film subsequently coming into or present in the passage, in accord with the information from said sensor.

19. The sensor of claim 18, wherein said apparatus comprises more than two pairs of said sensors and said means along said passage.

20. The apparatus of claim 19, wherein said means is a stopping device to prevent the entry or forward movement of said subsequent cartridge or disk film.

* * * * *